US012708162B2

(12) United States Patent
Song et al.

(10) Patent No.: US 12,708,162 B2
(45) Date of Patent: Aug. 18, 2026

(54) ARTIFICIAL EYELASHES USING LACE MATERIALS

(71) Applicant: Kiss Nail Products, Inc., Port Washington, NY (US)

(72) Inventors: Wanseok Song, Smyrna, GA (US); HeeKyong Hwang, Fresh Meadows, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 458 days.

(21) Appl. No.: 18/153,824

(22) Filed: Jan. 12, 2023

(65) Prior Publication Data

US 2023/0232927 A1 Jul. 27, 2023

Related U.S. Application Data

(60) Provisional application No. 63/298,945, filed on Jan. 12, 2022.

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS

| | | | | |
|---|---|---|---|---|
| 4,299,242 | A | 11/1981 | Choe | |
| 10,433,607 | B2 | 10/2019 | Ahn | |
| 2002/0000684 | A1 | 1/2002 | Nakanishi | |
| 2002/0056465 | A1 | 5/2002 | Shin | |
| 2009/0235950 | A1 | 9/2009 | Dinh | |
| 2010/0043816 | A1 | 2/2010 | Dix | |
| 2015/0250243 | A1* | 9/2015 | Woods | A41G 5/02 132/53 |
| 2016/0192724 | A1* | 7/2016 | Scott | A41G 5/02 132/53 |
| 2018/0242671 | A1 | 8/2018 | Merszei | |
| 2018/0352885 | A1 | 12/2018 | Kim | |
| 2019/0183200 | A1* | 6/2019 | Song | A41G 5/02 |

FOREIGN PATENT DOCUMENTS

| | | | | |
|---|---|---|---|---|
| GB | 2458230 A | * | 9/2009 | A41G 5/02 |

* cited by examiner

*Primary Examiner* — Rachel R Steitz
(74) *Attorney, Agent, or Firm* — Cherskov Flaynik & Gurda, LLC

(57) ABSTRACT

An artificial eyelash extension system is described. The system includes a support strip with at least one layer of lace material. The lace material has a top edge and a bottom edge opposite the top edge. The support strip has a front side and a back side opposite the front side. A number of eyelash filaments, each having a root and a tip, are coupled to the lace material layer or layers at the respective roots of the eyelash filaments.

15 Claims, 11 Drawing Sheets

ARTIFICIAL EYELASHES USING LACE MATERIALS

The current application claims priority as a non-provisional of U.S. application Ser. No. 63/298,945, filed on Jan. 12, 2022. The contents of the application are now incorporated by reference.

BACKGROUND OF THE INVENTION

1. Field of the Invention

The field of the invention is artificial eyelash extension systems having a support strip comprised of lace material and a method of use and manufacture of such systems.

2. Background of the Invention

Artificial eyelash extension systems bolster a wearer's natural eyelashes by resembling natural eyelashes as much as possible while minimizing discomfort to the wearer. Therefore, thin and lightweight materials are preferred in the construction of artificial eyelash extension systems. For this purpose, the present invention relates to using a lace-based or lace-containing material to hold the artificial eyelash filaments together.

In prior art approaches, artificial eyelash extension systems typically use a support strip made from one or more strings and glue. Each string is made from cotton, plastic, or other similar materials. In some prior art eyelash extension systems, individual eyelash filaments are knotted to a string, forming the support strip that holds the eyelash filaments to the eyelash extension system. An adhesive may be applied to the string to strengthen the knots, thereby securing the string's eyelash filaments. Such eyelash systems are generally referred to as knotted eyelash extension systems. In other prior art systems, generally referred to as mellow eyelash extension systems, eyelash filaments are placed on a tape (e.g., a double-sided tape) in desired orientations based on styles of the eyelash extension system (e.g., at a mostly uniform angle, at varying angles, crisscrossing one another). The tape temporarily holds the filaments in their desired orientations, and one or more strings are placed above the tape. Then, a sufficient amount of glue is placed along the string(s) and then dried to secure the eyelash filaments along the string(s), forming the support strip of the eyelash extension system after unnecessary or excess portions (e.g., the tape) are cut from it. Yet, in other prior art systems, the eyelash filaments are attached to the string(s) by using heat to melt eyelash filaments so that they are heat-fused with one another and/or with the string(s), forming the support strip.

In these prior art systems described above, the use of one or more strings to form the support strip is common, which can add to the thickness and/or the weight of the support strip. Such prior art systems also require that their users have a sufficient amount of natural eyelashes for effective application. Thus, they are less suitable for users who lack a sufficient amount of natural eyelashes.

Artificial eyelash extension systems that are thin and light yet remain in place and are easy to apply are highly advantageous. Also, systems that are suitable for users without a sufficient amount of natural eyelashes are desired.

A need exists in the art for lightweight artificial eyelash extension systems that innovatively use materials. A need also exists for a method of using and manufacturing such artificial eyelash extension systems.

SUMMARY OF INVENTION

An object of the invention is to provide artificial eyelash extension systems constructed using lace materials. A feature of the invention is the use of at least one layer of lace material for the support strip in the eyelash extension system construct. An advantage of the invention is that it provides lightweight eyelash extension systems which are sturdy. Another advantage of the invention is that it provides eyelash extension systems that can be easily applied to users for whom prior art systems are less suitable.

In one general aspect, an artificial eyelash extension system may include a support strip may include of at least one layer of lace material, where the lace material has a top edge and a bottom edge opposite the top edge and where the support strip has a front side and a back side opposite the front side. An artificial eyelash extension system may also include a plurality of eyelash filaments, each having a root and a tip, coupled to the at least one layer of lace material at the root. Other embodiments of this aspect include corresponding computer systems, apparatus, and computer programs recorded on one or more computer storage devices, each configured to perform the actions of the methods.

Implementations may include one or more of the following features.

The plurality of eyelash filaments may be coupled to the at least one layer of lace material by the roots of the plurality of eyelash filaments being (i) knotted, or (ii) glued, or (iii) heat fused or applied with heat, or (iv) by any combination of being knotted, glued, and heat fused.

The roots of the plurality of eyelash filaments may be coupled to the at least one layer of lace material along at least one of the bottom edge and the top edge of the lace material.

The back side of the support strip may be adapted to affix to a user's eyelid.

The support strip may be adapted to affix near or at where a user's natural eyelashes meet the user's eyelid on either the top side or underside of the user's natural eyelashes.

The plurality of eyelash filaments may comprise two layers of eyelash filaments, and the at least one layer of lace material may comprise one layer of lace material provided between the two layers of eyelash filaments.

One layer of the two layers of eyelash filaments may be coupled to the one layer of lace material at a first orientation with respect to the lace material, and other layer of the two layers of eyelash filaments may be coupled to the one layer of the lace material at a second orientation with respect to the lace material, and the first orientation is different from the second orientation.

The color of the lace material may be selected to match the user's skin tone.

The color of the lace material may be transparent or translucent.

The lace material may comprise a fabric composed of individual threads in an open web-like pattern.

The lace material may include a contiguous upper portion and a plurality of protrusions extending from the contiguous upper portion.

The plurality of eyelash filaments may be coupled to the lace material at the plurality of protrusions.

The support strip may be adapted to be cut by an end user at an arbitrary location.

The support strip may exclude material other than lace material.

The lace material may comprise lace material having variable strand thickness.

the plurality of eyelash filaments may be coupled to the support strip at various distances from a top edge of the support strip.

The plurality of eyelash filaments may be adapted to be repositioned on the support strip.

The support strip may comprise at least one protrusion

BRIEF DESCRIPTION OF THE DRAWINGS

The invention, together with the above and other objects and advantages, will be best understood from the following detailed description of the preferred embodiment of the invention shown in the accompanying drawings wherein:

FIGS. 7*a*-1 to 7*a*-7 depict example shapes of the lace material;

DETAILED DESCRIPTION OF THE INVENTION

The previous summary and the following detailed description of specific embodiments of the present invention will be better understood when read in conjunction with the appended drawings.

As used herein, an element or step recited in the singular and proceeded with the word "a" or "an" should be understood as not excluding plural said elements or steps unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The phrases "lash," "artificial eyelash," and "eyelash," as used herein, are interchangeable and refer to an apparatus that is not part of the wearer's body unless specifically indicated otherwise (e.g., phrases such as "natural eyelash" or "user's eyelash" refer to a part of the wearer's body). Also, the terms "adhesive" and "glue" are used interchangeably unless specified otherwise.

Support Strip Made Out of Lace

Figure 1:
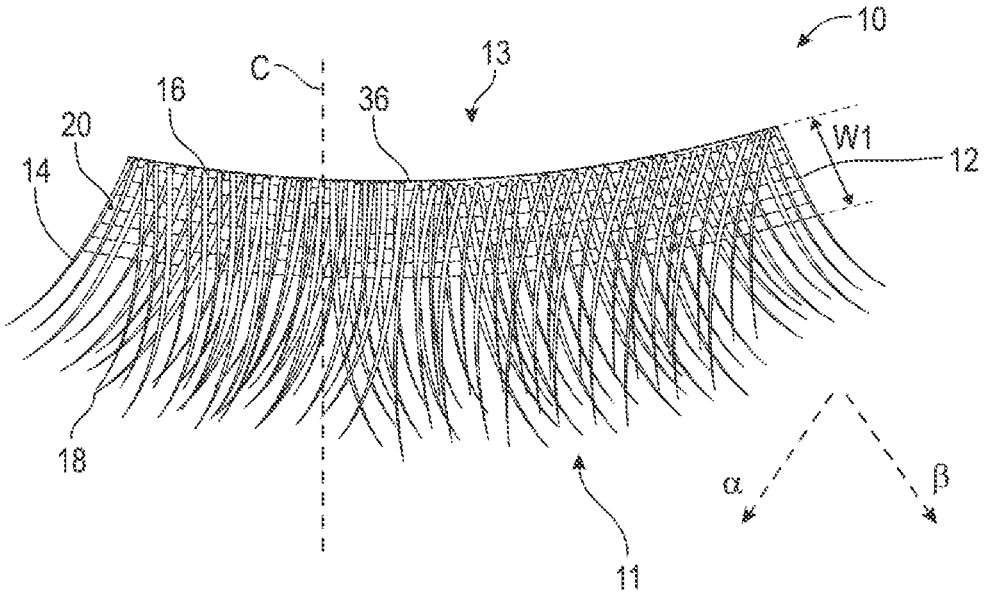
FIG. 1 depicts a front view of one embodiment of the invention.
Figure 2:
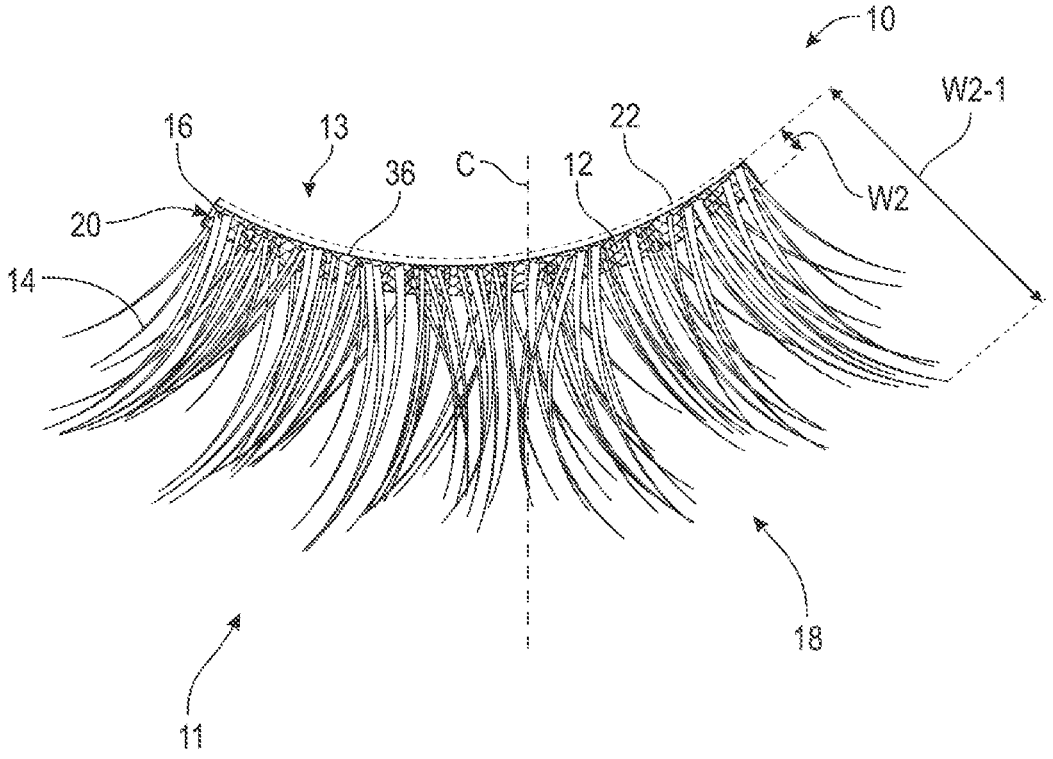
FIG. 2 depicts a front view of another embodiment of the invention.
Figure 3:
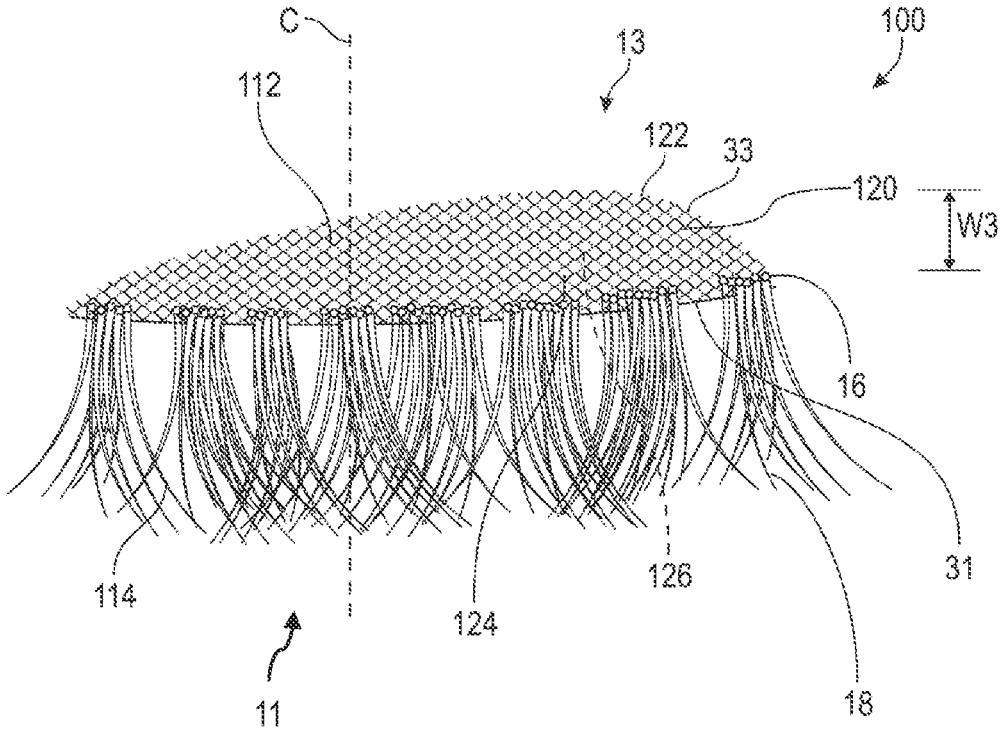
FIG. 3 depicts a front view of yet another embodiment of the invention.

Turning to the figures, FIGS. 1-3 depict embodiments of the artificial eyelash extension system 10, 100 of the present invention. The artificial eyelash extension system 10, 100 comprises a plurality of eyelash filaments 14, 114 and a support strip 12, 112 made from a lace material 20, 120 holding the plurality of eyelash filaments 14, 114. Each eyelash filament comprising the plurality of eyelash filaments 14, 114 includes a first end or tip 18, and a second end or root 16 opposite the tip 18. The tip 18 is a distal end of the eyelash filament 14, 114, and the root 16 is a proximal end of the eyelash filament 14, 114, when the artificial eyelash extension system 10, 100 is worn by a user. The eyelash filaments 14, 114 are coupled to the lace material 20, 120 at or around the root 16 of the individual eyelash filaments 14, 114 as well as over at least portions of the eyelash filaments' lengths, as will be discussed further below. The extension system 10, 100 has a distal end 11 comprised of the tips 18 of the eyelash filaments 14, 114 pointing away from the user's body when worn. It also has a proximal end 13 comprising the support strip 12, 112 in contact with the user's body when worn. As will be discussed subsequently, the eyelash filaments 14, 114 may be arranged as a single layer or into multiple layers.

In the embodiments shown in FIGS. 1-3, the eyelash filaments 14, 114 are kept in place by being attached to or coupled to at least one layer of lace material 20, 120. In these embodiments, the support strip 12, 112 comprises exclusively the lace material, and no string is used for the support strip 12, 112 because the lace material 20, 120 replaces the prior art use of one or more strings when forming the support strip 12, 112 that holds the eyelash filaments 14, 114. However, other embodiments may use one or more strings, or other material, in conjunction with lace materials 20, 120 to form the support strip 12, 112. The lace material 20, 120 is in contact with only a portion of the eyelash filaments 14, 114 over at least a portion of the width w1, w2, w3 of the lace material 20, 120, so that the tips 18 of the eyelash filaments 14, 114 are free hanging.

The widths w1, w2, w3 of the lace material 20, 120 can vary depending on the styles of the eyelash extension systems. For example, some may have a narrow width, such as the embodiment shown in FIG. 2, where the width w2 of the lace material 20 is around five percent of the overall width w2-1 of the eyelash extension system 10. In contrast, others may comprise a wider width, such as the widths w1 and w3 of the embodiments shown in FIG. 1 and FIG. 3. In FIG. 3, in particular, the lace material 120 may also have variability in the widths w3 within it, as further discussed below.

In some embodiments, the lace material 20, 120 may be comprised of plastic fibers or natural materials such as silk and linen, while the eyelash filaments 14, 114 may be comprised of nylon material or plastic material as well as human or mink hair. Details of the lace material 20, 120 are discussed further below.

Embodiments 10 shown in FIGS. 1 and 2 use two layers of eyelash filaments with a single layer of the lace material 20 placed between the two layers of eyelash filaments. In another embodiment designed to be lighter, there is only one layer of eyelash filaments 14 is placed on a layer of the lace material 20 (or vice versa).

In the embodiment 100 shown in FIG. 3, where the roots 16 of the eyelash filaments 114 are attached at, or close to, the bottom edge 31 of the lace material 120, the area of the lace material 120 that is not in contact with the eyelash filaments 114 is larger than the area that is in contact with the eyelash filaments 114. The lace material 120 and the support strip 112 have a front side 124 and a back side 126 (as better seen in FIG. 4*b*). As discussed below, the front side 124 faces away from the user when the eyelash extension system 100 is worn, while the back side 126 is in contact with the user's skin when worn.

FIGS. 4*a*-4*d* show representative examples of cross-sectional views of the artificial eyelash extension system 10, 100 along the line c of the embodiments 10, 100 shown in FIGS. 1-3. The support strip 12, 112 comprises a lace material 26 that has a top edge 33, 122 and a bottom edge 31 opposite the top edge 31. In the embodiments shown in FIGS. 4*a*-4*d*, the eyelash filaments 24, 28 protrude beyond the top edge 31 and extend away from the support strip 12, 112. The artificial eyelash extension system 10, 100 further includes a first layer of eyelash filaments 24 attached to the lace material 26.

Figure 4A:
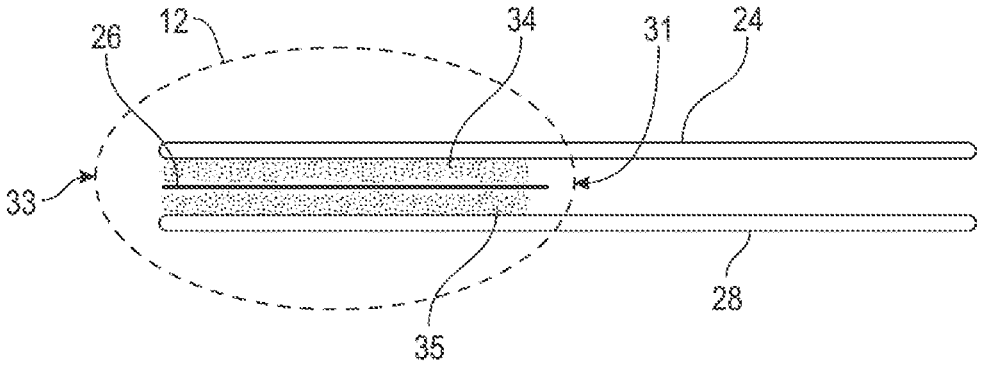
FIGS. 4*a*-4*d* depict cross-sectional views of the support strips used in some embodiments of the invention.
Figure 4B:
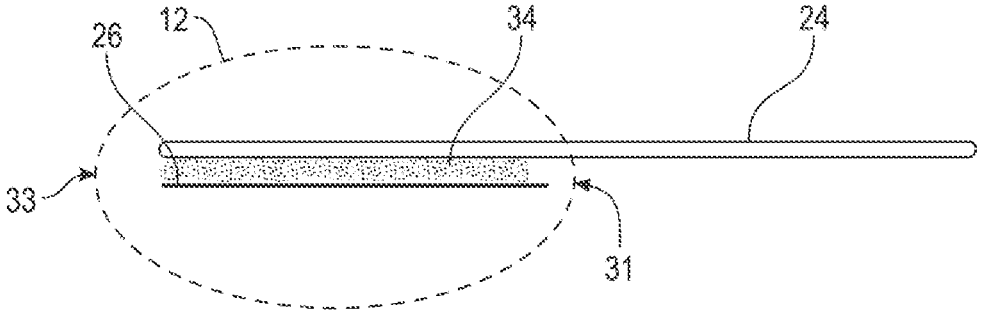
Figure 4C:
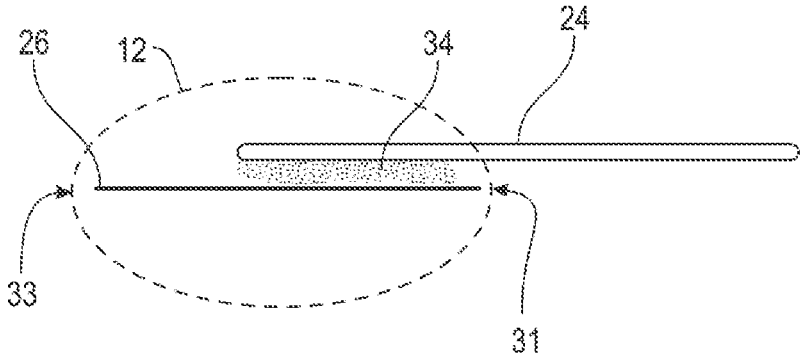
Figure 4D:
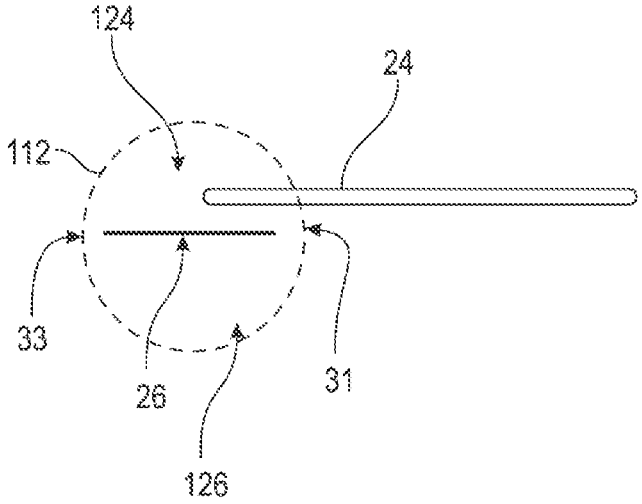

As can be appreciated from FIGS. 4*b*-4*d*, the support strip 12 has at least one layer of eyelash filaments 24. On the other hand, as shown in FIG. 4*a*, the support strip 12 can also have two layers of eyelash filaments 24, 28, where the lace material 26 is sandwiched between the two layers of eyelash filaments 24, 28. Also, in other embodiments (not shown), more than two layers, for example, two to five layers of eyelash filaments, are used. For example, in an alternative embodiment having three layers of eyelash filaments, a first lace material is placed between the first and second layers of eyelash filaments, and a second lace material is placed between the second and third layers of eyelash filaments. Additional layers of eyelash filaments and lace material may be further stacked in a similar manner. In other embodiments, the artificial eyelash extension system may instead include one layer of eyelash filaments sandwiched between two layers of lace material. Likewise, the artificial eyelash extension system may include more than two layers, for example, two to five layers, of eyelash filaments, each of which is sandwiched between two layers of lace material.

In FIG. 4*a*, the layer of lace material 26 is placed on the interior sides (which face the lace material) of the first and second layers of eyelash filaments 24, 28. A layer of adhesive 34 may be placed around or at the position between the layer of lace material 26 and the first layer of eyelash filaments 24. Also, a layer of adhesive 35 may be placed around or at the position between the layer of lace material 26 and the second layer of eyelash filaments 28. In some embodiments of FIG. 4*a*, just one layer of adhesive (34 or 35) may be added since the lace material 26 includes holes or spaces through which the adhesive can penetrate the lace material 26 to contact both the first and second layers of the eyelash filaments 24, 28. However, for an embodiment where the eyelash filaments are knotted to the lace material (as discussed further below), adhesive 34, 35 is optional. In the embodiment shown in FIGS. 4*a* and 4*b*, the adhesive 34 or 35 extends over most of the width of the lace material 26. However, in other embodiments, the adhesive may extend a portion of the width of the lace material as long as it may securely couple the root of the eyelash filaments to the lace material, especially in the embodiments when the width of the lace material is relatively large, such as that shown in FIG. 1. In addition, in other embodiments, the eyelash filaments 24, 28 may be attached to or coupled to the lace material 26 through soldering or fusion by, for example, heat, pressure, UV light, depending on the material of the eyelash filaments and lace material. For example, when at least one of the eyelash filaments and lace material is made of thermoplastics, the eyelash filaments may be coupled to the lace material through heat fusion or thermal welding.

FIGS. 4*b*-4*d* show representative examples of the support strip 12, 112 where just a single layer of eyelash filaments 24 is used. In FIG. 4*b*, the roots 16 of the layer of eyelash filaments 24 are near or along the top edge 33 of the support strip 12. In FIG. 4*c*, the roots 16 of the layer of eyelash filaments 24 are around the middle portion of the support strip 12, between near or at the top edge 33 and near or top of the bottom edge 31. In the embodiment shown in FIG. 4*d*, the roots 16 of the layer of eyelash filaments 24 are attached at or close to the bottom edge 31. In the embodiment of FIG. 4*d*, knotting may be used to attach the layer of eyelash filaments 24 to the lace material 26, but other means are also possible (e.g., glue, heat fusion, combinations thereof).

Figure 5:
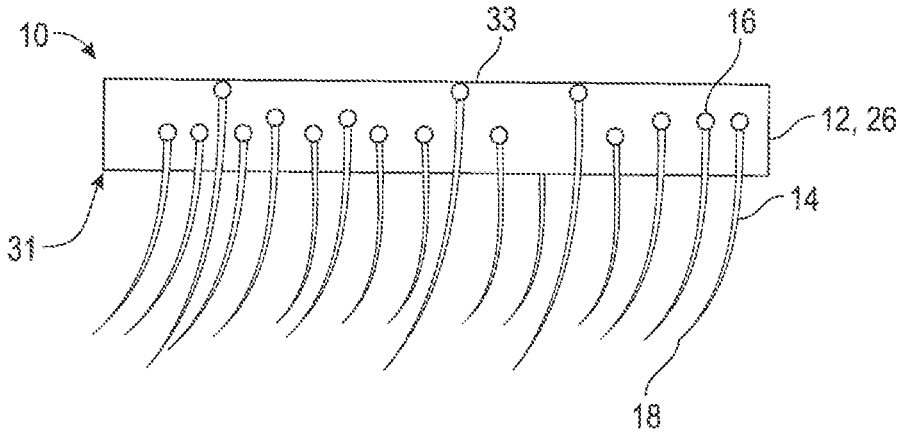
FIG. 5 depicts a view of the support strip of an embodiment of the invention.

Any combinations of FIGS. 4*a*-4*d* are also possible. For example, in an alternative embodiment (i.e., a combination of FIGS. 4*a* and 4*d*), the roots of the second layer of eyelash filaments 28 are coupled to the lace material along or close to the bottom edge 31 while the roots of the first layer of eyelash filaments 24 are coupled to the lace material along or close to the top edge 33 of the support strip 12. Other combinations are also possible (e.g., FIGS. 4*a* and 4*b*, FIGS. 4*a* and 4*c*, FIGS. 4*c* and 4*c* where the roots of the two layers of eyelash filaments 24, 28 are around the middle of the lace material 26, etc.). As another example, the eyelash filaments may be coupled to the lace material intermittently along the top edge or bottom edge or anywhere between the top edge and bottom edge, as shown in FIG. 3. Further, as shown in FIG. 5, the individual roots 16 of a layer of eyelash filaments 14 can be at various distances from the top edge 33 of the support strip 12. In at least one embodiment, the support strip 12 of lace material 26 is sufficiently wide that the end user may reposition the filaments 14 on the support strip 12. While initially, the roots 16 are adhered to the support strip 12, the roots 16 are adapted to be removable by the end user. The end user can apply fresh glue after repositioning the filaments 14. In at least one embodiment, the filaments 14 are attached using heat-sensitive glue, such that applying warmth transferred during handling of the filaments 14 will cause the filaments 14 to become repositionable.

The support strip 12, 112 creates a curve profile of the eyelash extension system of the present invention. For example, in embodiments of FIGS. 1 and 2, the proximal end 13 (or the top edge 33 of the support strip) creates the curve profile of the system 10. On the other hand, in the embodiment of FIG. 3, the curve profile of the extension system 100 is created by the support strip's bottom edge 31, where the roots 16 of the eyelash filaments 114 are attached. The curve profiles of the extension systems 10, 100 can vary depending on particular styles of the extension systems. For example, the proximal end 13 of the embodiment shown in FIG. 2 has a more curved curve profile 22 than the proximal end 13 of the embodiment shown in FIG. 1, which has a more linear curve profile. In an alternative embodiment, the support strip 12, 112, specifically, the lace material, is made of a certain flexible material so that a user may bend the support strip into the desired shape. For example, the user may bend the support strip 12, 112 corresponding to the contour of the user's eyelid or the edge of the user's eyelid along which their natural eyelashes extend from.

Eyelash Filament Arrangements

In the embodiments shown in FIGS. 1-3, the eyelash filaments 14, 114 are substantially cross-hatched such that the tips 18 point in various directions. For example, in FIG. 1, the tips 18 of one layer of eyelash filaments 14, 114 point in a direction shown by arrow a while the tips 18 of another layer point in a direction depicted by arrow p. Thus, the angle between the two arrows is approximately 90 degrees in one embodiment. However, in other embodiments, the angle between the layers will vary and not necessarily be 90 degrees, for example, in a range of 15 to 165 degrees, 30 to 150 degrees, 45 to 135 degrees, or 60 to 120 degrees. In addition, in other embodiments, individual eyelash filaments 14, 114 within a single layer have varying orientations so that there are various angles among the eyelash filaments 14, 114 in a given layer, as shown in FIGS. 2 and 3. As can be appreciated from these figures and the arrows, in at least one embodiment, one layer of the two layers of eyelash filaments is coupled to the at least one layer of lace material at a first orientation with respect to the lace material, and the other layer of the two layers of eyelash filaments is coupled to the second side of the lace material at a second orientation with respect to the lace material.

In yet other embodiments, the eyelash filaments generally point in the same direction (e.g., eyelash filaments are generally parallel to one another) so that there is less cross-hatching between the eyelash filaments than the embodiments of FIGS. 1-3. Also, there may be more than two layers of eyelash filaments (e.g., three layers of eyelash filaments, a first lace material between the first and second layers, and a second lace material between the second and third layers), where the eyelash filaments of each layer have varying orientations as described above.

In yet other embodiments, for aesthetic and style purposes, the eyelash filaments may knot with each other or be formed by lace material. For example, each of the eyelash filaments may be formed by lace material that is shaped into an elongated form or other forms such as triangular.

In eyelash extension systems of the present invention, the angles among individual artificial eyelash filaments may be created by, for mellow or heat fused systems, laying the eyelash filaments in desired directions and, for knotted systems, when knotting the eyelash filaments to the lace material (e.g., by pulling the eyelash filaments in desired directions while tightening the knots during knotting process). For stylistic purposes, after the eyelash filaments are secured to the lace material, the eyelash filaments may be ironed and/or combed to straighten them and/or make them extend in the desired direction, and they may then be pipe-rolled and heated to impart curls to them (e.g., rolling the eyelash filaments over a pipe and placing such rolled pipes in an oven). Such ironing and/or rolling processes can also create various directional orientations between the eyelash filaments and an appearance of volume, achieving a more natural appearance.

Lace Materials

Figure 6:
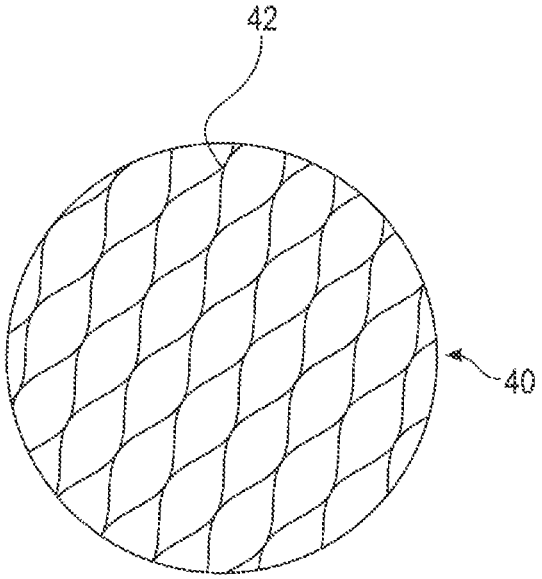
FIG. 6 depicts a detailed view of the lace used in some embodiments of the invention.

The details of the lace material 40 (20, 26, 120) are shown in FIG. 6. In some embodiments, the lace material 40 has a regular or irregular grid of plastic spun into a thread. In other embodiments, the lace material 40 includes multiple shapes. FIG. 6 shows an example lace material 40 that comprises a lace strand 42. The lace strand of FIG. 6 has a rhombus-shaped pattern, but specific patterns are not material, and other shaped patterns are possible, such as a triangle-shaped pattern. The strands 42 can be the Bride or Reseau in lace construction and are delicate, but it is strong enough so that it does not disintegrate. The strands 42 are also capable of supporting the layers of eyelash filaments, such as the layer of eyelash filaments 24, 28 shown in FIG. 4*a*. While the embodiment shown in FIG. 6 shows a single type of strand, a lace material with more than one type of strands may be used as well.

In one embodiment, the strands 42 have a diameter of about 80 μm and are approximately one-third thinner than the typical thickness of human hair. However, the strands 42 may have various diameters in different embodiments, for example, in the range of 60 to 400 μm, because the strand diameter of the lace material for this invention can be varied depending on hair types and style choices and the expected application of the artificial eyelashes. For example, if the artificial eyelashes will be used with heavy mascara to achieve a particular look, the strands 42 will likewise be heavier.

As used in the embodiments described in this invention, the lace material is a fabric composed of individual threads in an open web-like pattern. Many types of threads may be used for the lace fabric. Historically, lace material was made with linen or silk, with gold or silver threads introduced as well. Modern lace uses cotton threads as well as synthetic fibers. However, linen and silk lace materials are used in some embodiments. In general, the lace material is referred to by its region of origin or composition. Types or names of lace material include, but are not limited to: silk, French, Korean, and Swiss, as well as invisible or HD lace. Silk lace material primarily uses that material for its threads, creating a lightweight product. French lace material uses a variety of threads and is durable. It is suitable for applications where the lace material will be applied with adhesive and then removed many times. The Korean lace material is likewise durable but lighter than French lace material. Swiss lace material will use a finer composition than Korean lace material and blends well with skin tones, making it less visible to observers when applied on human skin. Invisible or HD lace material also exists, and it is often softer and less detectable than conventional Swiss lace material. Depending on style choices, different types of lace materials can be used to construct the support strip of the eyelash extension system of the present invention.

In one embodiment, the color of the layer of lace material is designed to match the skin tone of the user such that the layer of lace material is not discernable against the skin tone. For the embodiments described in this application, the lace material employs threads of silk, rayon, synthetic fibers, and a mix of other sources, including animal hairs and human hair. As the support strip is comprised of the lace material, the threads of the lace material use a color that matches the eyelash filaments of the eyelash extension system. The threads of the lace material can have a variety of colors, resulting in the final material having a specific color.

In one embodiment, the lace material has transparent strands. In another embodiment, the lace material has translucent strands. Other embodiments may have a combination thereof. Therefore, the support strip comprised of the lace material can have varying degrees of transparency when applied to the user, from less visible to more visible. For more visible embodiments, the colors of the lace material may vary based on the intended final style. For example, as discussed above, the color of the lace material is adapted to match the skin tone of the wearer of the artificial eyelash extension system. In such an embodiment, the artificial eyelash extension system is visible until they are applied to the skin of the wearer. In other embodiments, the color of the lace material may be different from the user's skin tone so that it provides a cosmetic effect similar to having applied an eyeshadow. In yet another embodiment, the lace material is adapted to match the color of the plurality of eyelash filaments. Alternatively, the lace material is adapted to match the color of eye makeup, such as mascara, eyeliner, or eye shadow. In this embodiment, the lace material can show a gradient of colors.

The color of the packaging for the lace material is selected to provide contrast with the color of the lace material, in one embodiment, to facilitate the removal of the eyelash extension system from the packaging.

Figures 1, 7A:
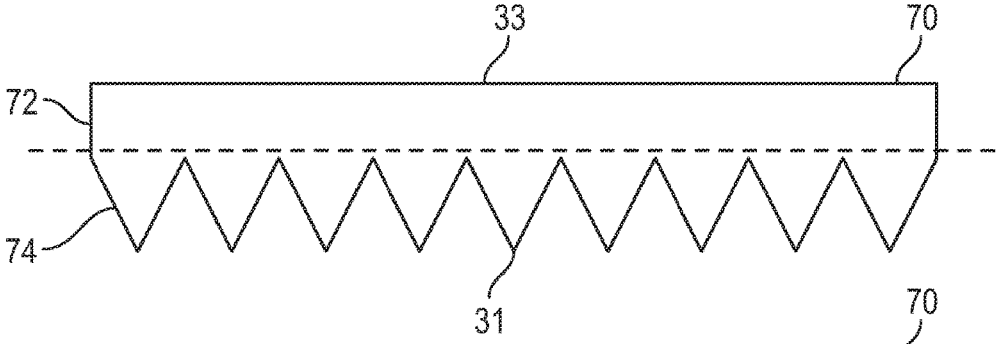
Figures 2, 7A:
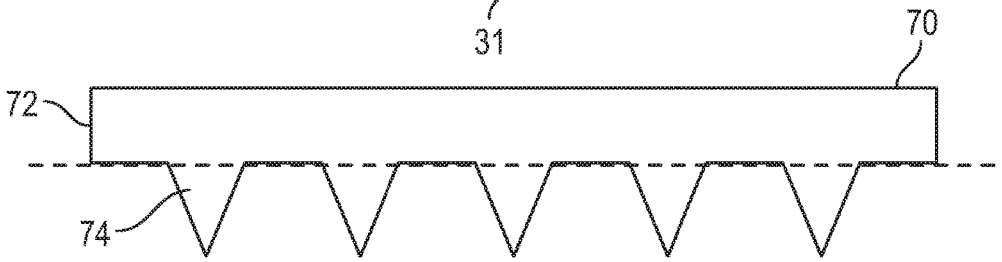
Figures 3, 7A:
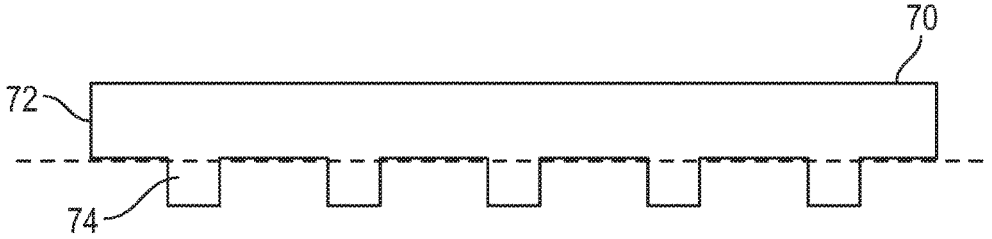
Figures 4, 7A:
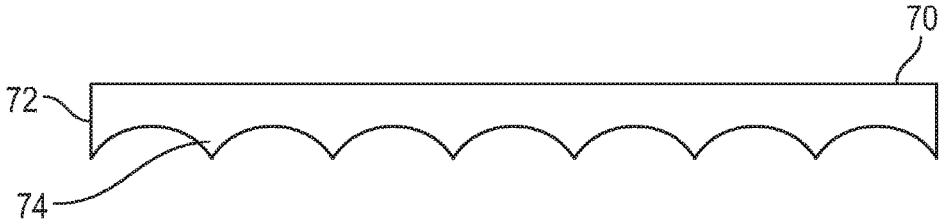
Figures 5, 7A:
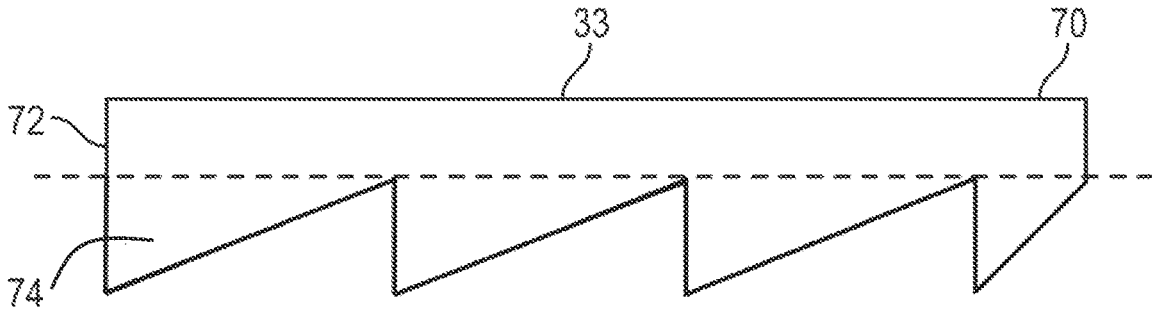
Figures 6, 7A:
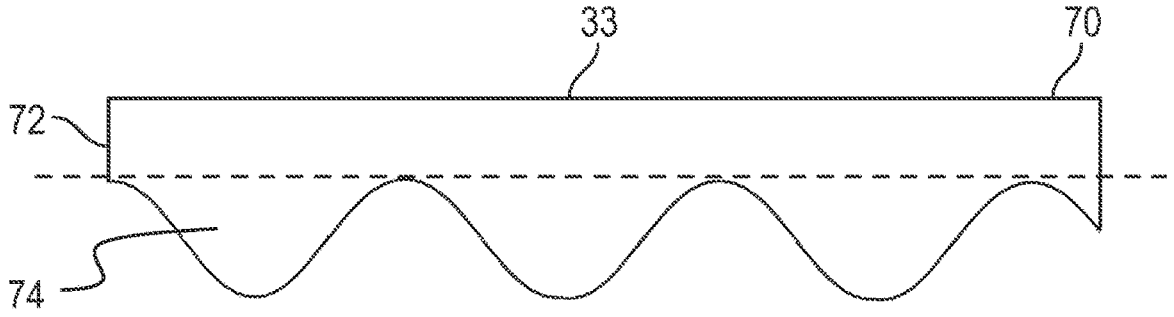
Figures 7, 7A:
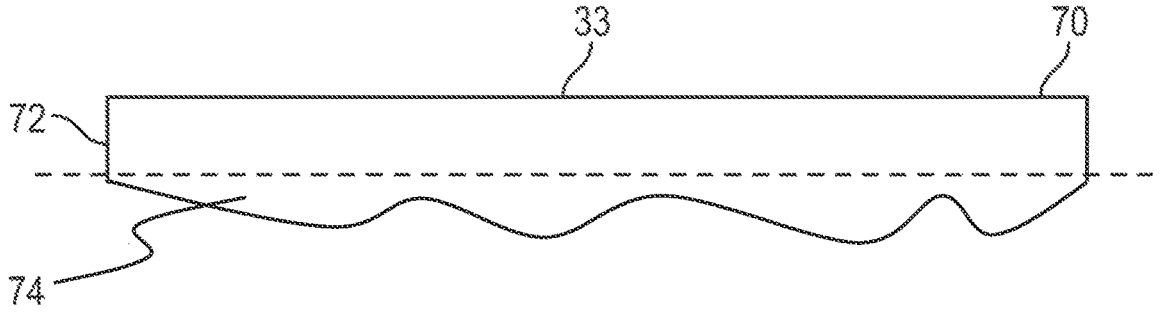
Figure 7B:
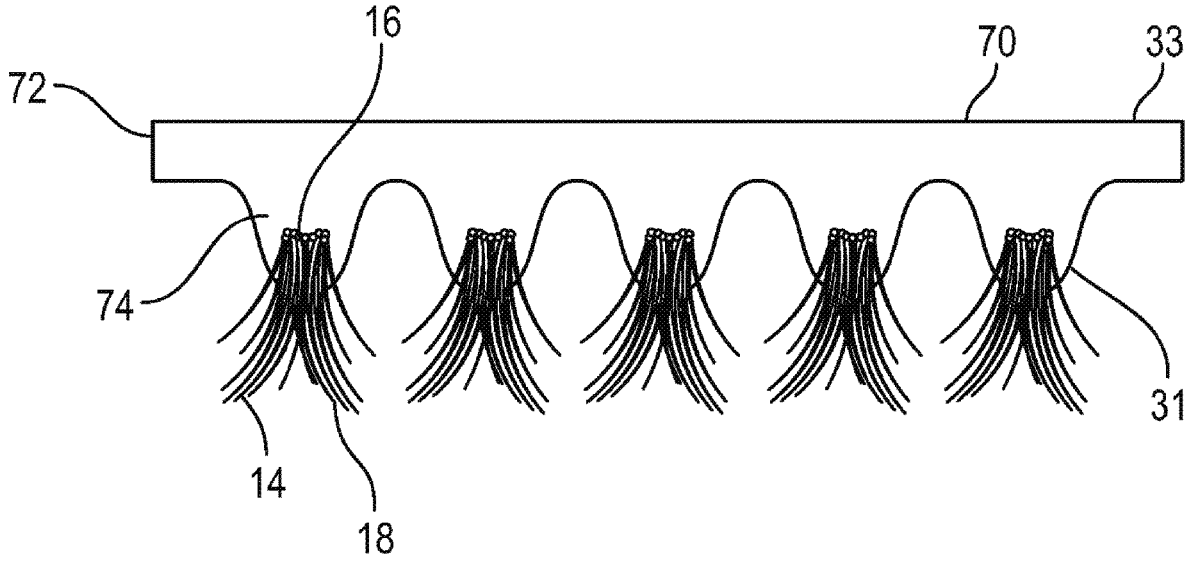
FIG. 7*b* depicts another example embodiment.

In embodiments shown in FIGS. 1-3, the lace material has various shapes, such as a generally rectangular shape, as shown in FIGS. 1 and 2, as well as alternative shapes, as shown in FIG. 3. FIGS. 7*a*1-6 and 7*b* show further examples of other alternative shapes. Each lace material 70 shown in FIGS. 7*a*1-6 and 7*b* has an upper portion 72 that is generally contiguous without breakages and a lower portion 74, which is comprised of a series of protrusions extending from the upper portion 72. The upper portion 72 is shown as a generally rectangular, but in other embodiments the upper portion 72 includes an upper section that is curved to approximate the shape of an eyelid. The protrusions of the lower portion 74 generally extend in the same direction as the direction of the eyelash filaments 14, as shown in FIG. 7*b*. The top edge 33 of the lace material 70 acting as a type of a support strip may comprise a shape profile of an oblong elongated widthwise or like a wedge, as shown in the embodiment of FIG. 3, but it can also be more rectangular as shown in FIGS. 5, 7*a*1-6, and 7*b*. The shapes of the protrusions of the lower portion 74 may include the general shape of a triangle wave type illustrated in FIG. 7*a*-1, a modified triangle wave shown in 7*a*-2, a square wave type illustrated in FIG. 7*a*-3, a repeating arc illustrated in FIG. 7*a*-4, a sawtooth wave type illustrated in FIG. 7*a*-5, a repeating periodic wave type illustrated in FIG. 7*a*-6, and an irregular shape illustrated in FIG. 7*a*-7. In addition, the spaces and/or distances between the protrusions in the lower portion 74 may generally match how eyelash filaments 14 protrude from the lace material 70, as shown in FIG. 7*b*. In other words, the plurality of the eyelash filaments may be coupled to the lace material at the protrusions of the lower portion 74. In addition, in the embodiments in which the lace material has a relatively large width, such as that shown in FIG. 3, users are allowed to cut the lace material into desired shapes to meet their intended style of application and eyelid width. In at least one embodiment, the lace material forming the support strip is adapted to be cut by an end user at an arbitrary location, both widthwise and lengthwise. This is accomplished by using a lace pattern which retains structural integrity, even if it is cut at an arbitrary location.

Attachment of Eyelash Filaments to the Lace Material

In one embodiment, the layers of eyelash filaments 14, 114 are attached to the lace material 20, 120 by adhesive. The eyelash filaments 14, 114 are not knotted to the lace material in this embodiment. But in other embodiments, the eyelash filaments 14, 114 are knotted to the lace material 20, 120, as discussed further below. In those embodiments that use knotting, using adhesive for attaching eyelash filaments 14, 114 to the lace material 20, 120 is only optional but may still be used to further strengthen the knots. Yet in another embodiment, the eyelash filaments 14, 114 may be heat fused to the lace material 20, 120 as well as with other eyelash filaments 14, 114. In such embodiment, using adhesive is also optional but may be used in conjunction with heat fusion to further strengthen the attachment of the eyelash filaments 14, 114 to the lace material 20, 120.

Also possible are embodiments that use any combination of the above techniques (using adhesive, knotting, heat fusing). For example, an embodiment may have some of the eyelash filaments 14, 114 being knotted to the lace material 20, 120 while other eyelash filaments 14, 114 are secured to the lace material 20, 120 by adhesive only. As another example, the eyelash filaments 14, 114 may first be knotted and/or glued to the lace material 20, 120 and then further heat fused to the lace material 20, 120. As yet another example, when the eyelash filaments 14, 114 and/or the lace material 20, 120 are made of thermoplastic, they may be attached to each other through heat fusion without using additional adhesive. The embodiments of the present invention can use any one or combination of the methods described above for attaching the eyelash filaments 14, 114 to the lace material 20, 120.

Application

Figure 8:
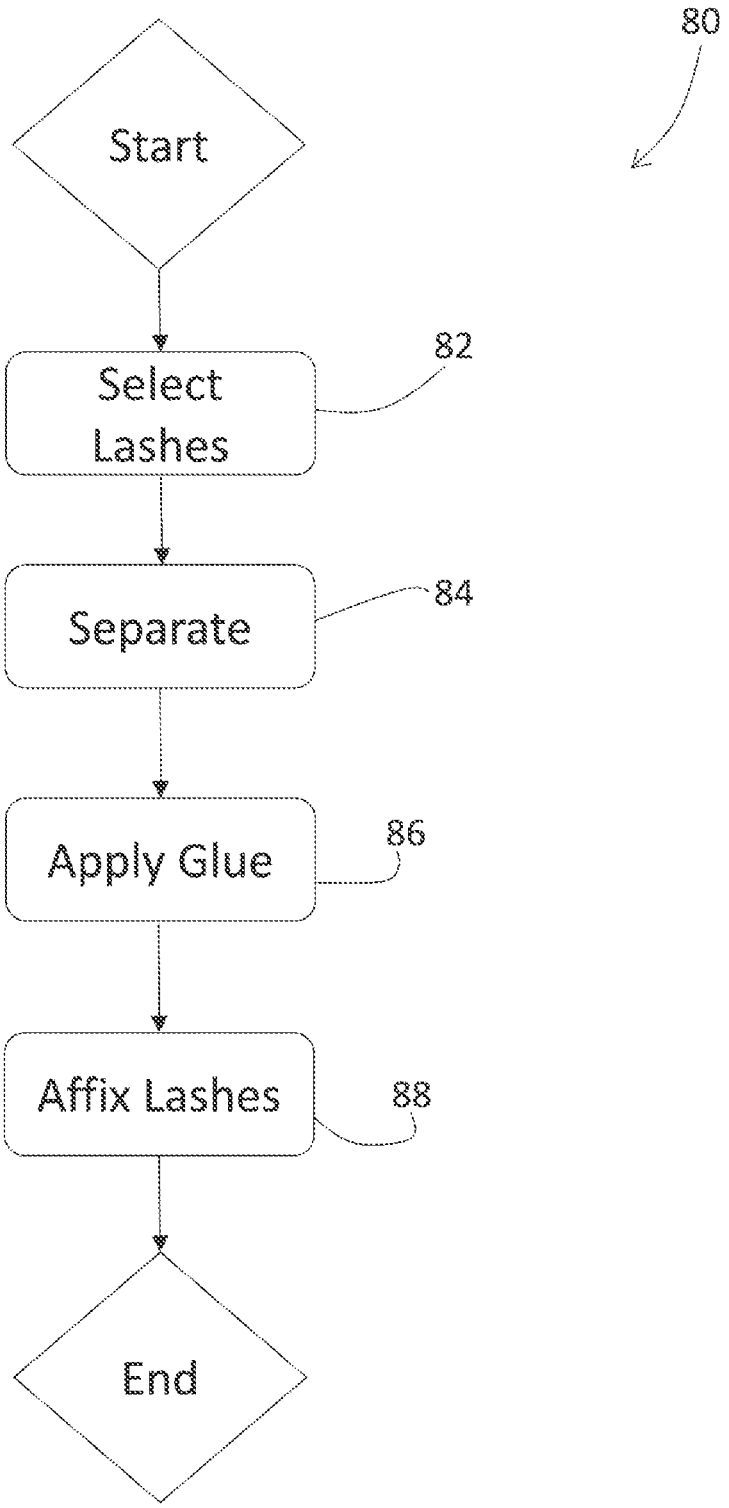
FIG. 8 depicts a schematic overview of using an embodiment of the invention.

An overview of the method of application of the eyelash extension systems of the present invention is shown in the flowchart in FIG. 8. The process begins by selecting 82, the artificial eyelash extension system. As described above, each embodiment of the artificial eyelash extension system has a different arrangement of the layer of eyelash filaments and layer of lace material. The different layers result in different appearances for the final artificial eyelash extension system.

Once the artificial eyelash extension system is selected, the artificial eyelash extension system is separated 84 from the packaging or other storage case. In one embodiment, the artificial eyelash extension system is reusable, and the box for storing the artificial eyelash extension system includes a glossy surface to allow for easy removal of the support strip, even if they have some remnant glue on them.

Next, the user will apply eyelash glue 86 to the support strip. The eyelash glue is in the form of a liquid in one embodiment, a gel in another embodiment. In other embodiments, the artificial eyelash extension system may come with adhesive already applied. In yet another embodiment, the adhesive is in the form of a tape, including a double-sided tape.

Further, at least some of the embodiments of the artificial eyelash extension system may be pre-glued, making the glue application step 86 unnecessary. In some pre-glued lashes, a protective film has to be removed from the pre-glued area instead of applying the glue itself. In other embodiments, the glue is water activated and so during the application step 86, the user has to apply a small quantity of liquid to the artificial eyelash extension system.

Following the application of the adhesive, in some embodiments, the adhesive is activated 87, such as by heating the eyelashes. As described above, the heating may occur by use of a dedicated heating implement or by placing the artificial eyelash extension system on a heating surface. The adhesive activation step 87 is optional, and so it is shown in dashed lines in the schematic of FIG. 8.

Finally, once the glue is applied (and optionally activated), the user will affix the artificial eyelash extension system 88 to the user's eyelid, usually with the support strip at or near where the user's natural eyelashes meet the user's eyelid, either on the top side or underside of the user's natural eyelashes. Based on the style of the support strip and the user's desire, the user may align either the top edge or the bottom edge with where the user's natural eyelashes meet the user's eyelid. The user may also affix the artificial eyelash extension system to elsewhere on their eyelids as desired.

Figure 9:
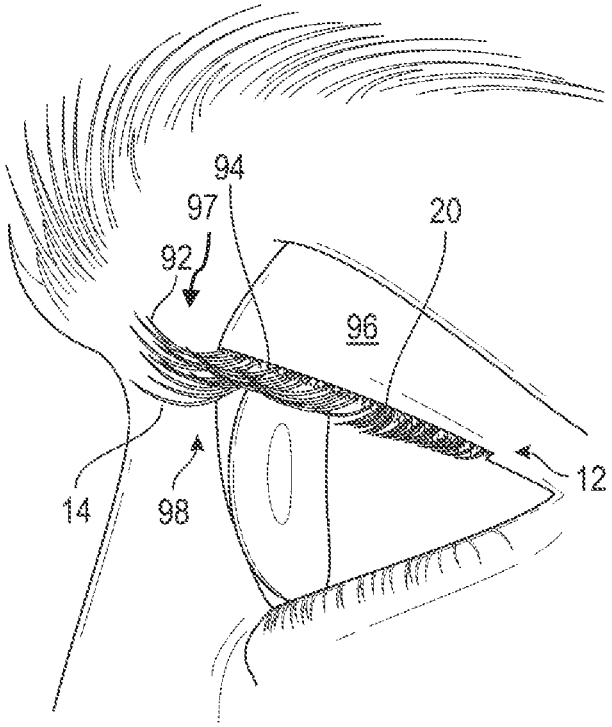
FIG. 9 depicts an example application of an embodiment of the invention.

FIG. 9 shows the application of embodiments shown in FIGS. 1, 2, 4*a*-4*c*, and 5. The support strip so formed has an application area 36 (as shown in FIGS. 1 and 2) for the application of adhesive to apply the eyelash extension system to a user the top side of a user's natural eyelashes 92 by affixing it at or near where the user's natural eyelashes meet the user's eyelid 94, either on the top side 97 or the underside 98 of the user's natural eyelashes 92. The width of the application area 36 depends on the type of application. For example, the application area 36 will be wider for under lash application compared to application on the top side of user's natural eyelashes because the top side of the eyelash filaments 14 will need to adhere to the underside 98 of the user's natural eyelashes 92.

Figure 10:
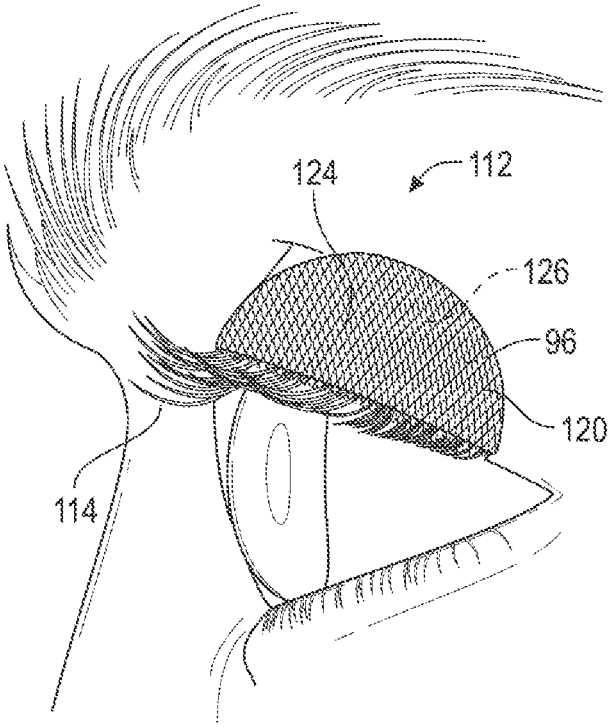
FIG. 10 depicts another example application of an embodiment of the invention.

FIG. 10 shows the application of embodiments where the roots 16 of the eyelash filaments 114 are at or close to the bottom edge 31 of the lace material 120, as shown in FIGS. 3 and 4*d*. In such embodiments, users apply them by affixing the back side 126 of the support strip 112 to their eyelid skin 96, as shown in FIG. 10. An adhesive is applied to the back side 126 of the support strip 112 (either pre-glued or applied before being affixed to user's eyelid, or both), which adheres the support strip's back side 126 to the user's eyelid skin 96. Thus, most or the entirety of the surface of the back side 126 of the support strip 112 is used for adhering the eyelash extension system to the user. As discussed above, the support strip 112 may be self-adhesive and include a pre-applied adhesive layer, and/or may also include an additional layer. In one embodiment, a transparent adhesive layer (e.g., transparent double-sided tape) is distributed separately from the support strip 112 or packed in a commercial packaging containing an eyelash extension system of the present invention. In most embodiments, the additional adhesive layer(s) is optional.

Although exemplary implementations of the invention have been depicted and described in detail herein, it will be apparent to those skilled in the relevant art that various modifications, additions, substitutions, and the like can be made without departing from the spirit of the invention. These are therefore considered to be within the scope of the invention as defined in the following claims.

It is to be understood that the above description is intended to be illustrative and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the invention parameters, they are by no means limiting but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels and are not intended to impose numerical requirements on their objects. Further, the limitations of the following claims are not written in means-plus-function format and are not intended to be interpreted based on 35 U.S.C. Section 112, sixth paragraph, unless and until such claim limitations expressly use the phrase "means for" followed by a statement of function void of further structure.

The embodiment of the invention in which an exclusive property or privilege is claimed is defined as follows:

1. An artificial eyelash extension system comprising:

a support strip including at least one layer of lace material, wherein the lace material has a top edge and a bottom edge opposite the top edge, and wherein the support strip has a front side and a back side opposite the front side; and a plurality of eyelash filaments, each having a root and a tip, coupled to the at least one layer of lace material at the root, wherein the top edge and the bottom edge of the lace material are substantially parallel to each other;

the plurality of eyelash filaments comprises two distinct layers of eyelash filaments, a first layer being attached directly to a front side of the lace material and a second layer being attached directly to an opposite back side of the lace material, such that the lace material is interposed between the two layers, the two layers extending in different orientations relative to the lace material.

2. The artificial eyelash extension system of claim 1, wherein the plurality of eyelash filaments are coupled to the at least one layer of lace material by the roots of the plurality of eyelash filaments knotted to the at least one layer of lace material.

3. The artificial eyelash extension system of claim 1, wherein the plurality of eyelash filaments are coupled to the at least one layer of lace material by the roots of the plurality of eyelash filaments glued to the at least one layer of lace material.

4. The artificial eyelash extension system of claim 1, wherein the plurality of eyelash filaments are coupled to the at least one layer of lace material by the roots of the plurality of eyelash filaments heat fused to the at least one layer of lace material.

5. The artificial eyelash extension system of claim 1, wherein the roots of the plurality of eyelash filaments are coupled to the at least one layer of lace material along at least one of the bottom edge and the top edge of the lace material.

6. The artificial eyelash extension system of claim 1, wherein the back side of the support strip is adapted to affix to a user's eyelid.

7. The artificial eyelash extension system of claim 6, wherein the support strip is adapted to affix near or at where a user's natural eyelashes meet the user's eyelid on either a top side or underside of the user's natural eyelashes.

8. The artificial eyelash extension system of claim 1, wherein a color of the lace material is selected to match a user's skin tone.

9. The artificial eyelash extension system of claim 1, wherein a color of the lace material is transparent or translucent.

10. The artificial eyelash extension system of claim 1, wherein the lace material comprises a fabric composed of individual threads in an open web-like pattern.

11. The artificial eyelash extension system of claim 1, wherein said support strip excludes material other than lace material.

12. The artificial eyelash extension system of claim 1, wherein said support strip is adapted to be cut by an end user at an arbitrary location.

13. The artificial eyelash extension system of claim 1, wherein said lace material comprises lace material having variable strand thickness.

14. The artificial eyelash extension system of claim 1, wherein the plurality of eyelash filaments are coupled to the lace material at various distances from the top edge of the lace material.

15. The artificial eyelash extension system of claim 14, wherein the plurality of eyelash filaments can be repositioned on the support strip.

* * * * *